US011486405B2

(12) United States Patent
Kammerer et al.

(10) Patent No.: US 11,486,405 B2
(45) Date of Patent: Nov. 1, 2022

(54) METHOD FOR DETERMINING A FLUID DELIVERY PARAMETER

(71) Applicant: ZIEHL-ABEGG SE, Künzelsau (DE)

(72) Inventors: Matthias Carsten Kammerer, Kupferzell (DE); Bjoern Wenger, Schrozberg (DE); Raphael Simon Obst, Öhringen (DE)

(73) Assignee: ZIEHL-ABEGG SE, Künzelsau (DE)

( * ) Notice: Subject to any disclaimer, the term of this patent is extended or adjusted under 35 U.S.C. 154(b) by 0 days.

(21) Appl. No.: 17/261,108

(22) PCT Filed: Jun. 12, 2019

(86) PCT No.: PCT/DE2019/200063
§ 371 (c)(1),
(2) Date: Jan. 18, 2021

(87) PCT Pub. No.: WO2020/015799
PCT Pub. Date: Jan. 23, 2020

(65) Prior Publication Data

US 2021/0317838 A1 Oct. 14, 2021

(30) Foreign Application Priority Data

Jul. 17, 2018 (DE) ..... 102018211869.8

(51) Int. Cl.
*F04D 27/00* (2006.01)

(52) U.S. Cl.
CPC .... *F04D 27/001* (2013.01); *F05D 2270/3061* (2013.01)

(58) Field of Classification Search
CPC ..... F04D 27/001; F05D 2260/821; F05D 2270/3061; F05D 2270/304; F05D 2270/334
See application file for complete search history.

(56) References Cited

U.S. PATENT DOCUMENTS

| | | | | |
|---|---|---|---|---|
| 2013/0309060 | A1* | 11/2013 | Johnsen | F04D 27/001 415/118 |
| 2014/0219820 | A1 | 8/2014 | Koki | |
| 2019/0203729 | A1* | 7/2019 | Nishimura | F04D 27/004 |

FOREIGN PATENT DOCUMENTS

| | | | | |
|---|---|---|---|---|
| CN | 107035712 B | * | 7/2018 | F04D 27/001 |
| DE | 19851523 | | 5/2000 | |
| DE | 19851523 C1 | * | 5/2000 | F04D 27/001 |
| JP | S60201097 | | 10/1985 | |
| WO | 2017059897 | | 4/2017 | |

* cited by examiner

*Primary Examiner* — Topaz L. Elliott
(74) *Attorney, Agent, or Firm* — FisherBroyles, LLP; Jason P. Mueller

(57) ABSTRACT

The invention relates to a method for determining a fluid conveying parameter, a fluid conveying device, particularly for determining a volumetric flow, comprising the steps of Determining excitation information for mechanical excitation of at least one fluid conveying element of the fluid conveying device in at least one spatial direction by at least one first sensor means, Providing operating information, comprising at least a value of an operating variable of the fluid conveying device by means of a providing means, Analyzing the information provided and determined, Determining a fluid conveying parameter, particularly a volumetric flow, of the fluid conveying device based on the analyzed information.

16 Claims, 3 Drawing Sheets

METHOD FOR DETERMINING A FLUID DELIVERY PARAMETER

Figure 1:
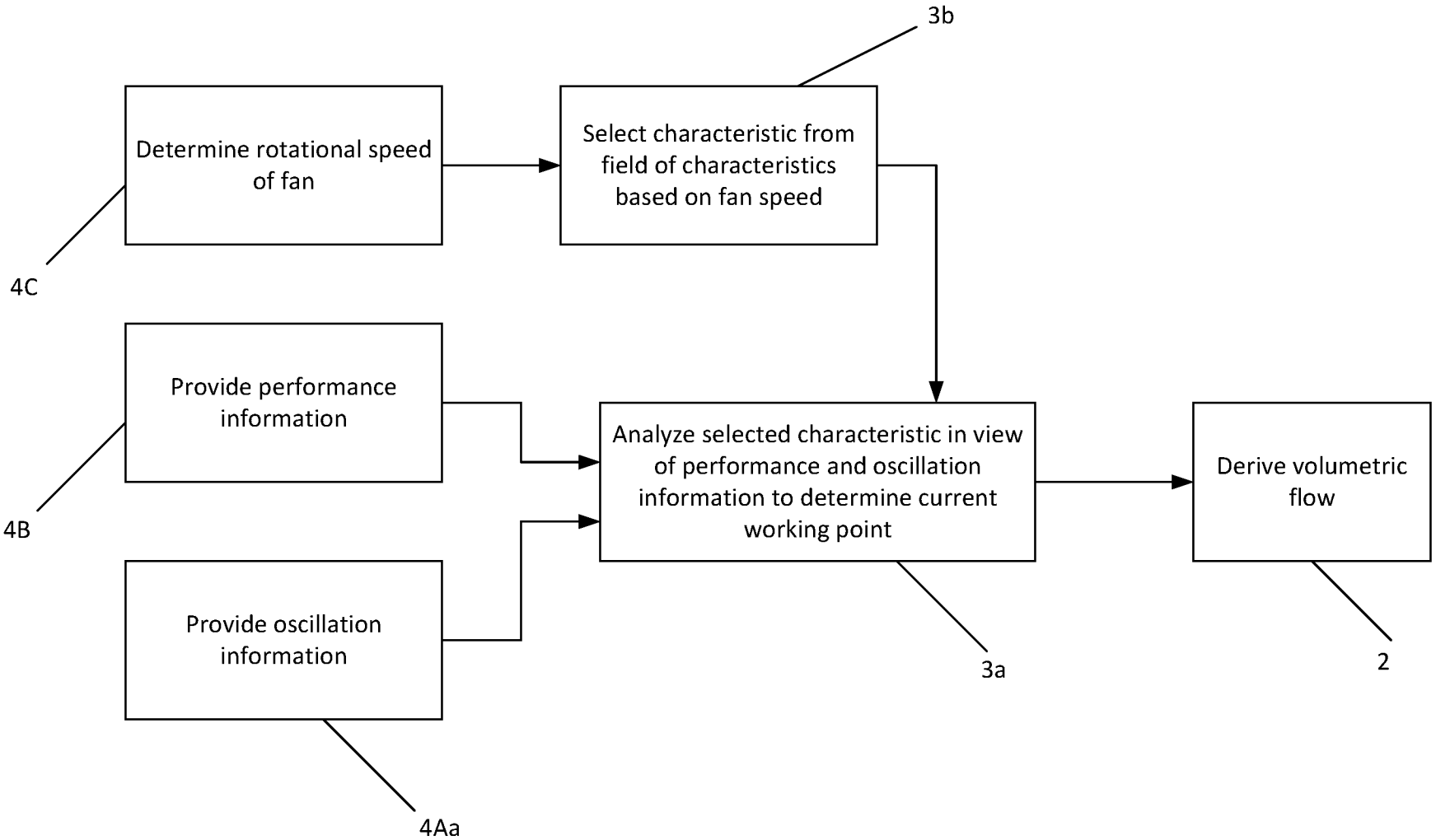

The invention relates to a method for determining a fluid conveying parameter, a fluid conveying device, particularly for determining a volumetric flow.

The invention further relates to a device for determining a fluid conveying parameter, a fluid conveying device, particularly for determining a volumetric flow.

The invention further relates to a fluid conveying system.

Although the present invention can generally be applied to any desired fluid conveying devices, the present invention is described with reference to a ventilator or fan.

Ventilators or fans are used in manifold ways, for example in the field of ventilation and air conditioning technology. Knowledge of the current operational state of the ventilator is required fore efficient operation and adjustment of the fan to operating conditions. For example, a characteristic line of a radial fan which reflects the output of the radial fan by means of the delivered volumetric flow, drops from the maximum load working point to both sides, that is, to lower and higher volumetric flows. If the fan output is known, this results in two working points which cannot be distinguished with respect to volumetric flow. These, for example, can only be determined by a great effort based on the installation situation of the fan together with control data for the fan, in order to then be able to make conclusions regarding the volumetric flow.

It is therefore a problem of the present invention to specify a method for determining a fluid conveying parameter and a fluid conveying system which can easily and reliably determine the working point and thus a fluid conveying parameter of the fluid conveying device. It is another problem of the present invention to provide a simple and cost-effective implementation. It is yet another problem to specify an alternative method and an alternative fluid conveying system.

In one embodiment, the present invention solves the problems by means of a method for determining a fluid conveying parameter of a fluid conveying device, particularly for determining a volumetric flow, comprising the steps of

- Determining excitation information for mechanical excitation of at least one fluid conveying element of the fluid conveying device in at least one spatial direction by at least one first sensor means,
- Providing operating information, comprising at least a value of an operating variable of the fluid conveying device by means of a providing means,
- Analyzing the information provided and determined,
- Determining a fluid conveying parameter, particularly a volumetric flow, of the fluid conveying device based on the analyzed information.

In another embodiment, the present invention solves the problems by means of a device for determining a fluid conveying parameter of a fluid conveying device, particularly for determining a volumetric flow, comprising

- a sensor means for determining excitation information for mechanical excitation of at least one fluid conveying element of the fluid device in at least one spatial direction,
- a providing means for providing operating information, comprising at least a value of an operating variable of the fluid conveying device, and
- a computing unit for analyzing the information provided and determined and for determining a fluid conveying parameter, particularly a volumetric flow, of the fluid conveying device based on the analyzed information.

In another embodiment, the present invention solves the problems by a fluid conveying system, comprising

- a fluid conveying means, particularly in the form of a fan, having at least one fluid conveying element, particularly in the form of an impeller, and
- a device for determining a fluid conveying parameter of the fluid conveying device according to any one of claims 9-12.

One of the advantages achieved is that it allows unambiguous determination of an operating or work point with respect to the volumetric flow within the fluid conveying device without tedious additional measurements by separate measuring instrument. Another advantage is that such information can also be provided to a user or operator of the fluid conveying device and be utilized by this individual. Furthermore, the fluid conveying parameter determined can be flexibly used for controlling and regulating the fluid conveying device and/or for calculating, such as the service life of the fluid conveying device or the like.

Other features, advantages, and further embodiments of the invention are described below or become apparent thereby.

According to an advantageous further development, one or multiple oscillations of the fluid conveying element are provided as the variable of mechanical excitation. The advantage here is that conclusions regarding the operating point with respect to the volumetric flow can be drawn easily and simultaneously based on signals of an oscillation of the fluid conveying element.

According to another advantageous further development, an amplitude and/or a change of an amplitude of the variable of mechanical excitation is measured. The advantage here is that values for the variable of mechanical excitation can easily be determined or measured.

According to another advantageous further development, the operating information is evaluated before analyzing based on a stored and/or predetermined characteristic field for operating information. This characteristic field can be used to simply and reliably link, for example, the rotational speed of an impeller of a fan to the output and volumetric flow of a fan.

According to another advantageous further development, the fluid conveying device is provided in the form of a fan, particularly a radial fan, and the fluid conveying element is provided in the form of an impeller. In this manner, a fluid conveying device can be provided in a simple and cost-effective manner.

According to another advantageous further development, operating information provided is performance information of the fluid conveying device, particularly current, voltage, and/or power consumption and/or a rotational speed of the fluid conveying device. The advantage achieved is once again that performance data can be used as operating information, which is generally already present as a signal. This means that there is no need for any great effort to detect these variables separately. At the same time, the accuracy of determining the fluid conveying parameter is improved.

According to another advantageous further development, the information is determined as a function of time, particularly if a development over time of the respective information is determined. The advantage of this is that small variations over time of operating variables, such as the rotational speed of the impeller, etc. can be detected and optionally averaged out, which improves the accuracy of mapping to an operating point and thus determining the fluid conveying parameter.

According to another advantageous further development, the values are prepared prior to analysis, particularly by means of a fast Fourier transformation. The advantage of this is that analysis of the values can be improved, which improves accuracy when determining the fluid conveying parameter and reduces the computing and storage expense.

According to another advantageous further development of the system, a closed-loop control unit is provided which is configured to control the fluid conveying means based on the fluid conveying parameter determined. This enables a particularly stable and continuous operation of the fluid conveying means.

According to another advantageous further development, the sensor means comprises an oscillation sensor and/or the providing means is configured to provide information of a control device of the fluid conveying device. The advantage of this is easy provision of information about a mechanical excitation and other operating variables.

According to another advantageous further development, the computing unit comprises a memory in which at least one characteristic field for one or more operating variables of the fluid conveying device is stored and which is configured to provide the at least one characteristic field of the fluid conveying means to the computing unit for determining the fluid conveying parameter. The advantage of this is easy and fast provision of a characteristic field for determining.

Other important features and advantages of the invention are apparent from the dependent claims, from the drawings, and from the associated description of the figures with reference to the drawings.

It will be appreciated that the features mentioned above and the features to be explained below cannot just be used in the combination described but in any other combination or by themselves, without deviating from the scope of the present invention.

Preferred designs and embodiments of the invention are shown in the drawings and will be explained in the description below, wherein like reference symbols refer to like or similar or functionally identical components or elements.

Wherein

Figure 2:
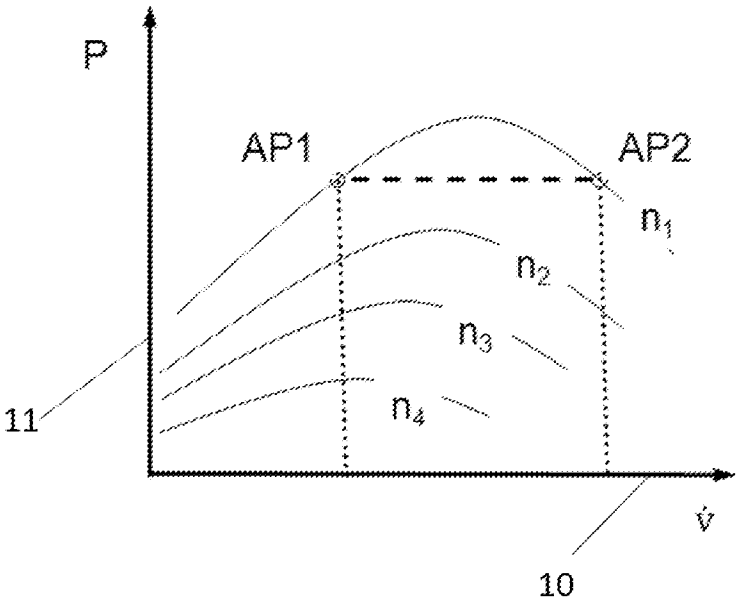
Figure 3:
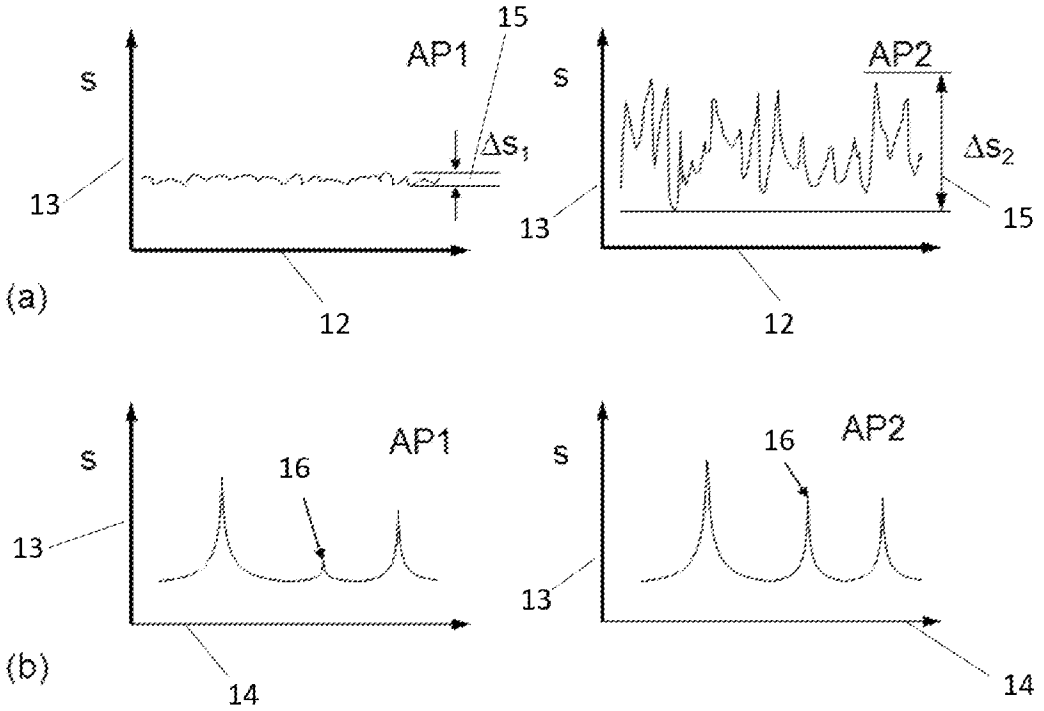

FIG. 1 schematically shows a method according to an embodiment of the present invention;

FIG. 2 shows a characteristic field of a radial fan according to an embodiment of the present invention, and FIG. 3 shows oscillation characteristics for various working points for the radial fan according to FIG. 2.

FIG. 1 schematically shows a method according to an embodiment of the present invention.

FIG. 1 provides oscillation information 4*a* and performance information 4*b* and matches it with a characteristic field 3*b*, starting from a rotational speed information 4*c*, for example of an impeller of a fan. The information 4*a*, 4*b*, 4*c* is then used to determine a characteristic line 3*a*, from which the volumetric flow 2 can be derived. In detail, for example, a characteristic line 3*a* is selected from the known characteristic field 3*b* of a radial fan depending on the rotational speed 4*c*, which is known in a motor electronics. Information about the performance 4*b* of the radial fan and along with it the rotational speed demand of the impeller of the radial fan is known from a control device of the radial fan. This information, in conjunction with the selected characteristic line 3*a*, is used based on the known impeller-specific correlation of oscillation excitation (oscillation information 4*a*) and volumetric flow to determine the current working point. The volumetric flow information determined in this manner can subsequently be used for closed-loop control of a constant volumetric flow, for example.

FIG. 2 shows a characteristic field of a radial fan according to an embodiment of the present invention.

In detail, FIG. 2 shows the characteristic field of a radial fan with backward curved blades. The performance 11 of the radial fan is plotted over the volumetric flow 10 for various rotational speeds $n_1$, $n_2$, . . . . The characteristic line ($n_1$, $n_2$, . . . ) drops on both sides starting from the respective maximum load point, that is towards lower or higher volumetric flows. If the respective motor or fan output is known, this results in two working points AP1 and AP2 which cannot be distinguished with respect to volumetric flow. The difference is due, among other things, to the system resistance and thus to the installation situation of the radial fan.

FIG. 3 shows oscillation characteristics for various working points of the radial fan according to FIG. 2.

In detail, FIG. 3 now shows the oscillation state present at the working points AP1 and AP2 mentioned in FIG. 2. This state results from the interaction of impeller and volumetric flow, which represents an exciting mass. When analyzing the oscillation information, a characteristic of the oscillation as a function of the individual impeller geometry is obtained, which correlates with the volumetric throughput of the impeller of the radial fan. For example, as shown in FIG. 3*a*, the time-dependent signal 13 of the oscillation sensor can be analyzed for the two working points AP1, AP2 with respect to its amplitude or signal variation 15. The signals 13, more precisely their variation, are clearly different for the two working points AP1, AP2. Alternatively, as shown in FIG. 3*b*, a signal analysis can be performed to identify characteristic frequency ranges 14 having signal peaks 16 for the two working points AP1, AP2. The oscillation characteristic can then be correlated with the respective volumetric flow.

In summary, at least one of the embodiments of the present invention allows or provides one of the following features and/or at least one of the following advantages:

- A fan having a means for determining its operating state with respect to its output and rotational speed as well as a sensor for analyzing its mechanical oscillation behavior.
- A combination of performance data such as current, voltage, or other operational variables and information on mechanical excitation, such as oscillation amplitudes, oscillation rates, or a characteristic in the form of an oscillation spectrum for creating a defined operating point with respect to volumetric flow or pressure difference, taking into account known characteristic fields of the fan regarding speed-dependent output and volumetric flow. Currents, output, etc. can be used by a control device on the basis of signals of an oscillation sensor, particularly measured path changes x, y, z or, after their analysis using, for example, fast Fourier transformation or another signal evaluation method and using other known variables, to map a mass or volumetric flow.
- Determining a volumetric flow within the fan motor or its control/regulating device without additional measuring equipment, particularly volumetric flow, pressure or the like. Potential output of the information to a customer, for example, the volumetric flow as a user-side output parameter.
- The option of internal utilization in a controller for closed-loop control of the fan and/or for obtaining other operation-specific parameters, e.g. for its service life calculation.

Although the present invention was described with reference to preferred embodiments, it is not limited to these and can be modified in manifold ways.

LIST OF REFERENCE SYMBOLS

2, 10 volumetric flow
3*a* characteristic line
3*b* characteristic field
4*a* oscillation information
4*b* performance information
4*c* rotational speed
AP1, AP2 working point
11 output
12 time
13 path/elongation
14 frequency
15 difference max/min elongation
16 peaks

The invention claimed is:

1. A method for determining a fluid conveying parameter of a fluid conveying device, comprising the steps of:

determining excitation information for a mechanical excitation of at least one fluid conveying element of the fluid conveying device in at least one spatial direction by at least one first sensor;

providing operating information including at least a value of an operating variable of the fluid conveying device;

accessing a memory storing at least one characteristic field for one or more operating variables of the fluid conveying device;

analyzing the excitation information and the operating information to determine a current working point of the fluid conveying device;

determining the fluid conveying parameter of the fluid conveying device based on the analyzed information, wherein the fluid conveying parameter comprises a volumetric flow.

2. The method of claim 1, wherein the mechanical excitation comprises one or more oscillations of the fluid conveying element.

3. The method of claim 2, wherein the step of determining excitation information comprises determining at least one of an amplitude and a change in amplitude of the mechanical excitation.

4. The method of claim 1, wherein the step of determining excitation information comprises determining an amplitude or a change in amplitude of the mechanical excitation.

5. The method of claim 1, further comprising the step of evaluating the operating information before analyzing the excitation information using a stored and/or predetermined field for operating information.

6. The method of claim 1, wherein the fluid conveying device comprises a fan and the fluid conveying element comprises an impeller of the fan.

7. The method of claim 1, wherein the operating information comprises performance information of the fluid conveying device.

8. The method of claim 7, wherein the performance information comprises one or more of current, voltage, power consumption and rotational speed.

9. The method of claim 1, wherein the excitation information is determined as a function of time.

10. The method of claim 9, wherein the operating information is provided as a function of time.

11. The method of claim 10, further comprising the step of preparing the excitation information and the operating information using a fast Fourier transformation, prior to analyzing the excitation information and the operating information.

12. A device for determining a fluid conveying parameter of a fluid conveying device, comprising:

a sensor for determining mechanical excitation information for at least one fluid conveying element of the fluid conveying device in at least one spatial direction, a provider for providing operating information, the operating information including at least a value of an operating variable of the fluid conveying device, a computing unit configured to analyze the mechanical excitation information and the operating information to determine a current working point of the fluid conveying device and configured to determine a fluid conveying parameter of the fluid conveying device based on the analyzed information, wherein the fluid conveying parameter comprises a volumetric flow, and wherein the computing unit comprises a memory configured to store at least one characteristic field for one or more operating variables of the fluid conveying device.

13. The device of claim 12, further comprising a closed-loop control unit which is configured to provide control signals for the fluid conveying device based on the fluid conveying parameter.

14. The device of claim 12, wherein the sensor comprises an oscillation sensor and/or the provider is configured to provide operating information of a controller.

15. A fluid conveying system, comprising a fluid conveying device having at least one fluid conveying element, and a device for determining a fluid conveying parameter of the fluid conveying device according to claim 12.

16. The fluid conveying system of claim 15, wherein the fluid conveying device comprises a fan and the fluid conveying element comprises an impeller.

* * * * *